United States Patent [19]

Mercer

[11] Patent Number: 4,753,092

[45] Date of Patent: Jun. 28, 1988

[54] SYSTEM FOR CONTROLLING THE USE OF A PLURALITY OF ITEMS

[75] Inventor: Donald E. Mercer, Garner, N.C.

[73] Assignee: Key Kontrol Systems, Inc., Sneads Ferry, N.C.

[21] Appl. No.: 835,650

[22] Filed: Mar. 3, 1986

[51] Int. Cl.[4] ..... E05B 11/00

[52] U.S. Cl. ..... 70/389; 70/456 R

[58] Field of Search ..... 70/389, 456 R, 61, 429, 70/430, 456 B–459; 211/4–9

[56] References Cited

U.S. PATENT DOCUMENTS

| | | | |
|---|---|---|---|
| 2,220,786 | 11/1940 | Grainger | 70/262 |
| 2,336,936 | 12/1943 | Johnson | 70/61 |
| 4,367,827 | 1/1983 | Keller | 70/389 |
| 4,472,952 | 9/1984 | Hollowoll | 70/389 |
| 4,641,509 | 2/1987 | Batchelor | 70/388 |

FOREIGN PATENT DOCUMENTS

| | | | |
|---|---|---|---|
| 1500003 | 2/1978 | United Kingdom | 70/389 |

*Primary Examiner*—Robert L. Wolfe

*Attorney, Agent, or Firm*—Rhodes, Coats & Bennett

[57] ABSTRACT

This invention is a system for controlling the use of keys and other items which allows only one item to be removed from a plurality of available items and an indicator of who made the selection. The present invention has particular application where a plurality of different people, such as salesmen, have access to a plurality of different items, such as keys. This control is accomplished through the provision of an unlocking means which cannot be relocked until the article contained therein has been replaced.

3 Claims, 3 Drawing Sheets

SYSTEM FOR CONTROLLING THE USE OF A PLURALITY OF ITEMS

FIELD OF INVENTION

This invention relates to security means and more particularly to means for controlling the use of a plurality of items by a plurality of different individuals.

BACKGROUND OF INVENTION

Wherever there has been a plurality of items used by a plurality of different parties, there invariably developes a problem of control. This control problem is particularly exemplified in vehicle sales lots where keys for each of the vehicles is usually hung on a key board and whenever one of the usually numerous salesmen wishes to demonstrate a vehicle he removes the key from the board for such purpose.

The problem is, first, there is no way of knowing who has the keys to a given vehicle if such keys have been removed from the board and, therefore, when another salesman wants to demonstrate the vehicle, he has no way of knowing who to ask for the keys. Also, the salesman may show several different vehicles to a prospective customer without returning any of the keys to the key board thus compounding the matter.

Secondly, a salesman will usually put the keys to a vehicle after demonstrating the same in his pocket and quite often will forget and go home still carrying such keys in his pocket. The next day he may leave the keys at home or, being embarrassed that he forgot to return them to the key board, may throw them in the trash. As a result of these types of problems, locksmiths are required to vist car lots on a regular basis to make new keys for vehicles where the keys have been lost, misplaced, or are otherwise not available.

BRIEF DESCRIPTION OF INVENTION

After much research and study into the above-mentioned problems, the present invention has been developed to provide a system for controlling the use of a plurality of items by a plurality of different people. This is accomplished through the provision of a plurality of lockable chambers, each fitting the same key. Each of the locks is of the type that when in the open position, the key cannot be removed. Thus, when a lock is manipulated to open a specific chamber to remove an item therefrom, the key cannot be removed from the lock until the item is replaced therein.

With each key having special indicia associated therewith, the unremoved key in an open chamber can readily be traced from the indicia to the person assigned that key.

Once the item is replaced in the chamber, the same can be relocked and the key removed for use in unlocking any other chamber decided upon. Thus, it can be seen that when a person assigned a key with a specific indicia unlocks a chamber and removes the item therefrom, such person's key is retained in the lock until such item is replaced therein and relocked, at which time the key can be removed. If an open chamber is noted, the indicia is simply read from the key and it is immediately known who has the item that has been removed from such chamber.

In view of the above, it is an object of the present invention to provide a control system for a plurality of items used by a plurality of people.

Another object of the present invention is to provide a control means for a plurality of items wherein when any given item is missing, it is readily determinable who removed the same.

Another object of the present invention is to provide, in a control system for a plurality of items, means for preventing the removal of any given item without an indiciation of who removed the same.

Another object of the present invention is to provide the means for assuring that one item is returned to its preassigned location prior to removal of a second item.

Another object of the present invention is to provide a control means for a plurality of keys used by a plurality of persons.

Another object of the present invention is to provide a means for controlling the use of keys and similar items wherein whenever one such item is removed, there is an indication of who removed it until it is replaced.

Another object of the present invention is to provide a key board control system which allows only one key to be removed at the time and which also indicates the party removing the same.

Another object of the present invention is to provide a key board with an individual security system for each set of keys.

Another object of the present invention is to provide a key board with security means for each set of keys and a security means for the entire board.

Other objects and advantages of the present invention will become apparent and obvious from a study of the following description and the accompanying drawings which are merely illustrative of such invention.

DETAILED DESCRIPTION OF INVENTION

With further reference to the drawings, the item control system of the present invention, indicated generally at 10, includes a securable control panel indicated generally at 11. Operatively associated with this control panel are a plurality of securable chambers, indicated generally at 12.

Figure 1:
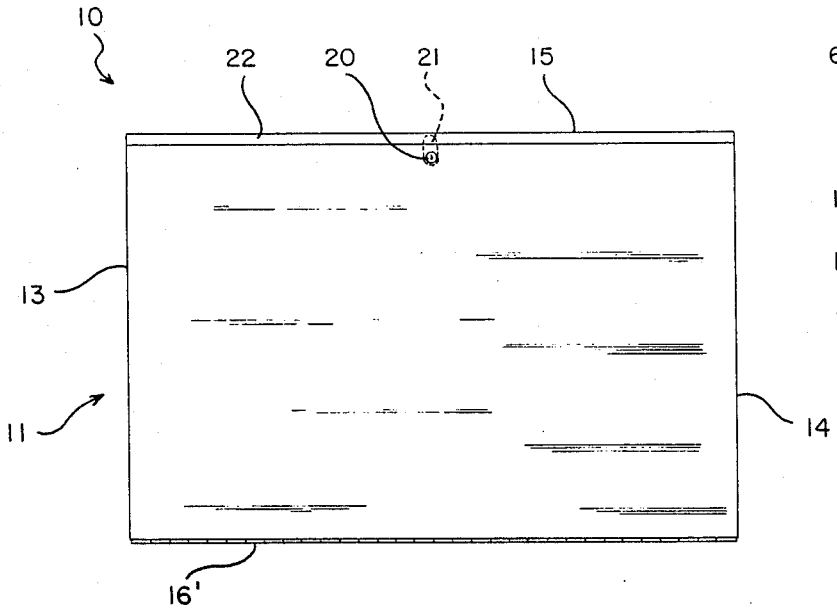
FIG. 1 is a front elevational view of the item control system of the present invention in closed position.
Figure 2:
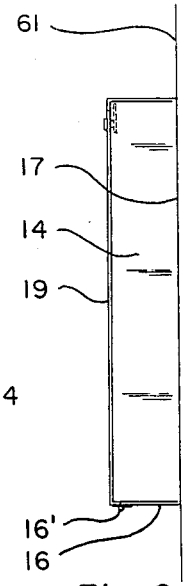
FIG. 2 is a side elevational view thereof.

The control panel 11 includes sides 13 and 14, a top 15, and a bottom 16. Such panel also includes a back 17 and a slightly inset front 18. A closure or cover 19 for securing the control panel 11 is hingedly connected to bottom 16. A securing means such as a key operated lock 20 has a pivotable latch arm 21 which can be moved from the unlocked position shown in Figure 2 to a position in locked engagement with front lip 22 as shown in FIG. 1.

Figure 3:
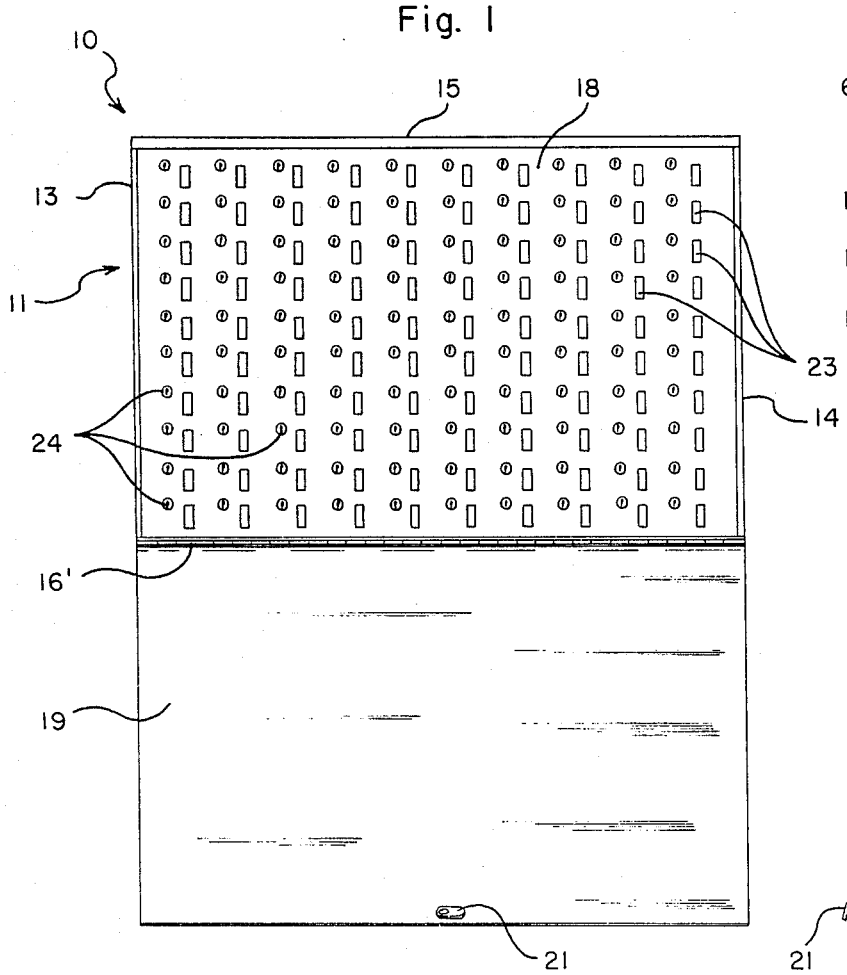
FIG. 3 is a front elevational view of such control system in the open, use position.
Figure 4:
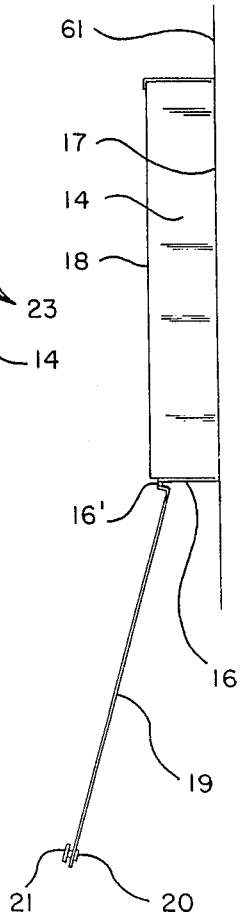
FIG. 4 is a side elevational view thereof.

The front 18 of control panel 11 has a plurality of chamber openings 23 provided thereon. A lock or similar securing means 24 is provided adjacent each of the chamber openings 23 as can clearly be seen in FIG. 3.

Each of the chamber openings 23 in front 18 of control panel 11 communicates with the interior of one of the securable chambers 12. Each of the securable chambers 12 has a pair of flanges 25 and 26 disposed on opposite sides of its chamber opening 23. These flanges are secured to the back side of panel front 18 by spot weldment or other suitable means.

Projecting rearwardly from the above-mentioned flanges is a box-like structure including a top and bottom 27 and 28, sides 29 and 30, and a rear or end wall 31. A slotted secondary sidewall 32 is disposed parallel to and in spaced relation with sidewall 30.

A slot is also provided in sidewall 30 extending from rear wall 31 approximately one-third of the distance to flange 26. This slot is disposed in alignment with the slot in secondary wall 32.

Figure 6:
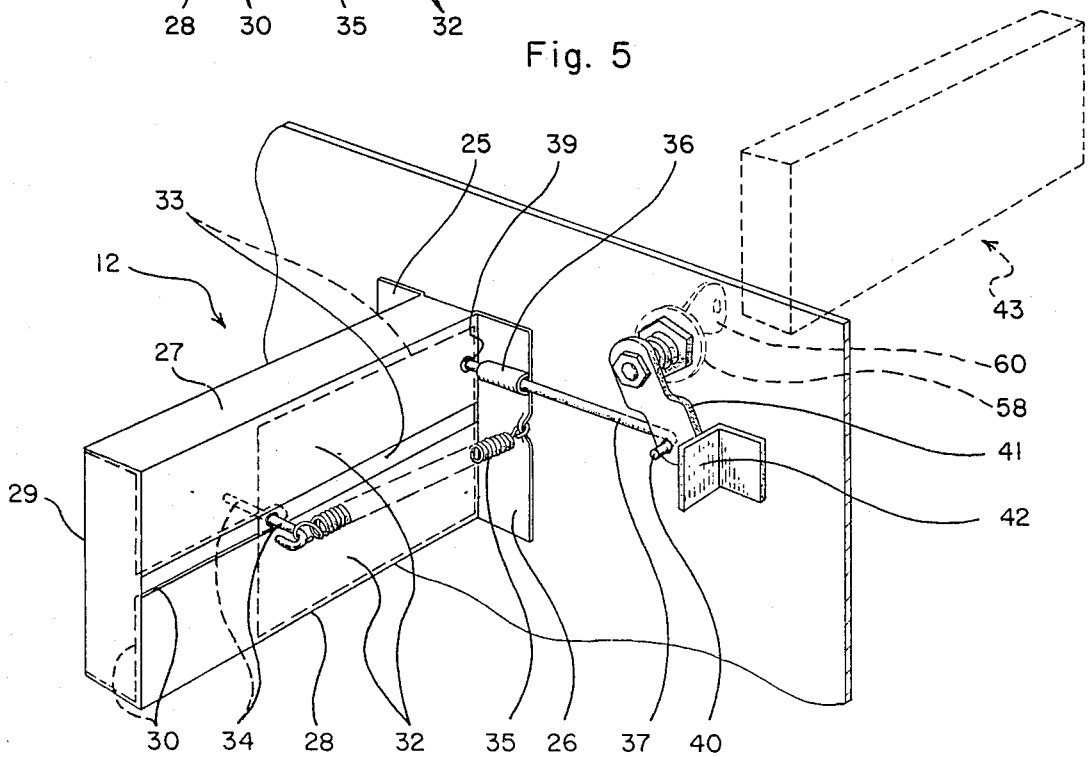
FIG. 6 is a rear elevational view of such chamber in unlocked, open position with the item removed therefrom.

A plate 33 is slideably mounted in the area between sidewall 30 and slotted secondary wall 32 as can clearly be seen in FIG. 6. This slide plate has a J-shaped control finger 34 passing through and secured to said slide plate adjacent its rear edge as can clearly be seen in FIG. 6.

A means such as spring 35 is provided to bias control finger 34 and its associated slide plate 33 toward the open end 23 of chamber 12. This biasing means or spring is secured at one end to control finger 34 and at the other end to eyelet 36 formed in the edge of flange 26. Thus, the forward end of slide plate 33 is adapted to lie within the pocket formed between sidewall 30 and slotted wall 32 adjacent flange 26 when chamber 12 is empty.

Figure 5:
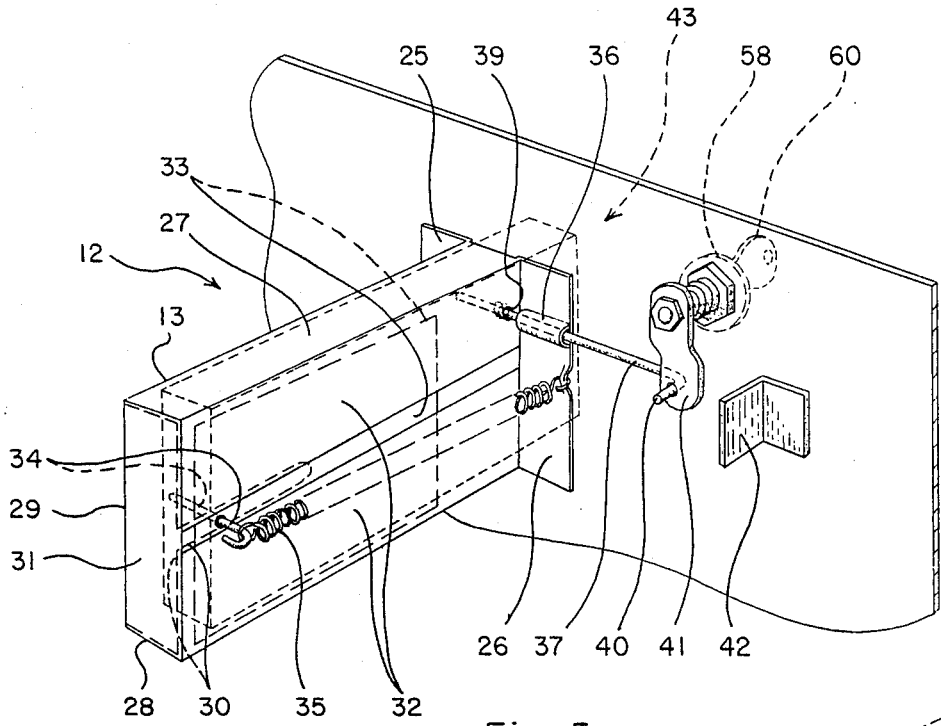
FIG. 5 is a rear perspective view of an individual chamber with its associated item locked in place.

A sleeve guide 36 is mounted on the rear of flange 26 as can clearly be seen in FIGS. 5 and 6. Locking rod 37 passes through sleeve guide 36 and aligned opening 38 and wall 32. When the slide plate 33 is in the position shown in FIG. 6, locking rod 37 is blocked from passing beyond opening 38.

On the other hand, when slide plate 33 is in the position shown in FIG. 5, locking rod 37 can pass through opening 38 in wall 32 and through aligned opening 39 of wall 30 as will hereinafter be described in greater detail.

The opposite end of locking rod 37 from its engagement with guide 36 has a hooked end 40 which pivotably engages control arm 41 of lock 24. If desired, a stop 42 can be provided on the back of front wall 18 adjacent lock 24 to prevent locking rod 37 from moving out of engagement with sleeve guide 36.

A typical item which is adapted to be lockingly disposed within chamber 12 is indicated generally at 43. This item can be formed from a plastic or similar type material.

If the plurality of items being controlled by the present invention are keys or similar means, the itemm can include two channel-like halves 44 and 45 with upper flanges 44' and 45' and lower flanges 44'' and 45''.

End panel 46 hingedly connects channel-like half 44 and 45 along hinge lines 47 and 48 respectively.

Figure 7:
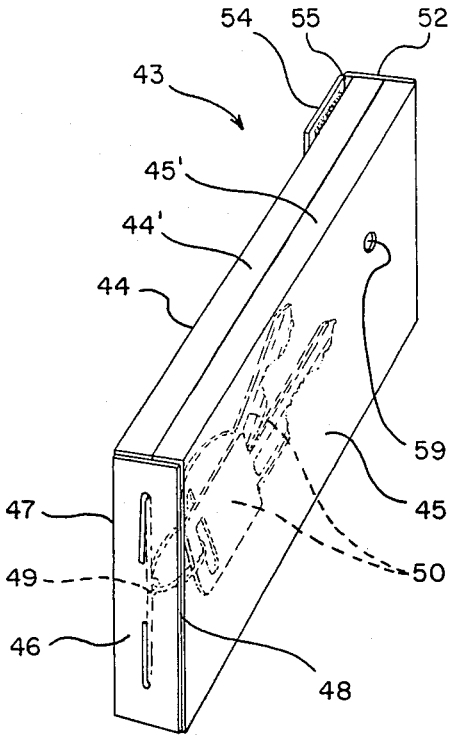
FIG. 7 is an elevational view of one side of the removable item.

A U-shaped attaching means 49 is mounted on the inside of end panel 46 as can clearly be seen in FIG. 7. Keys or other selected items can be secured to attaching means 49 by suitable means such as ring 51. Since securing rings of this type are well known to those skilled in the art, further detailed description of the same is not deemed necessary.

A closure 52 is pivotably secured along hinge line 3 to channel-like half 45. A closure flap 54 is pivotably mounted to closure 52 along hinge line 55. Velcro-type securing means 57 in the form of a fabric-like material on one surface and a hook-like material on the other surface is used to secure the flap 54 of closure 52 to half 44 as can clearly be seen in FIGS. 7 and 8. Fastening means of this type that are sold under the brand name Velcro, are well known to those skilled in the art, and further detailed description of the same is not deemed necessary.

Figure 8:
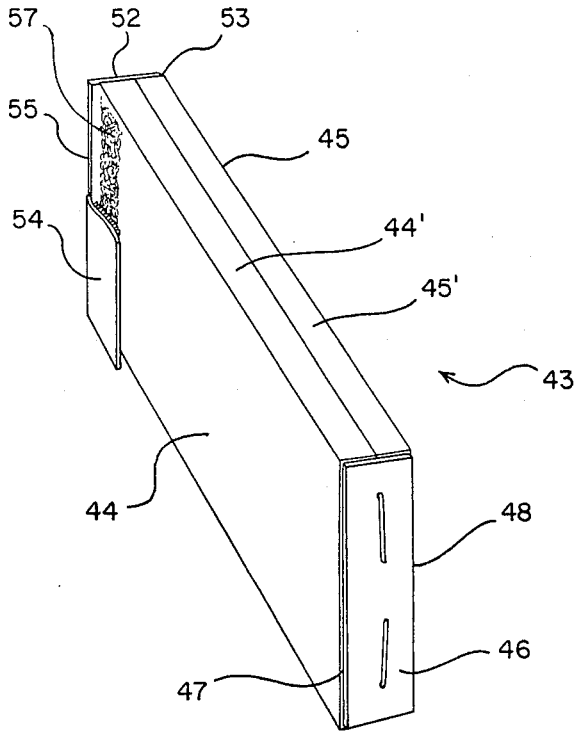
FIG. 8 is a perspective view of the opposite side of the removable item.

To use the control system of the present invention, keys or other similar means are secured to attaching means 49 and item 43 is folded over and closed into the configuration shown in FIGS. 7 and 8. A pass key 58, which is adapted to operate each of the locks 24, is inserted into the lock adjacent the chamber to be used. When inserted the key is disposed vertically and is then turned from such position shown in FIG. 5 to the position shown in FIG. 6 to withdraw locking rod 37 from the interior of securable chamber 12.

Item 43 is then inserted into the chamber and as the end panel 46 engages control finger 34 and such item is pushed further into the chamber, slide plate 33 will be moved against the bias of spring 35 rearwardly. This rearward movement of slide plate 33 clears the axial passage through openings 38 and 39 of walls 32 and 30.

Once item 43 has been fully inserted into chamber 12, lock opening 59 in such item will be in axial alignment with openings 38 and 39 and locking rod 37. Manipulation of key 58 from the open position in FIG. 6 to the locked position in FIG. 5 will cause locking rod 37 to move into engagement with lock opening 59 of item 43 thus securing the same within chamber 12. The pass key 58 can then be removed from lock 24.

As heretofore mentioned, locks 24 are of the type that when in the locked position shown in FIG. 5, pass key 58 can be removed therefrom, but when in the unlocked position shown in FIG. 6, such key cannot be removed from such lock. Since key retaining locks of this type are well known to those skilled in the art, further detailed discussion of the same is not deemed necessary.

Inversely, when item 43 is desired to be removed from chamber 12, key 58 is inserted into lock 24 and manipulated from the locked position shown in FIG. 5 to the unlocked position shown in FIG. 6. The item 43 can then be removed from such chamber. Once removed, slide plate 33 will block the axial passage through openings 38 and 39 thus preventing locking rod 37 from moving from the unlocked position and only reinsertion of item 43 will allow lock 24 to be relocked so key 58 can be removed.

Figure 9:
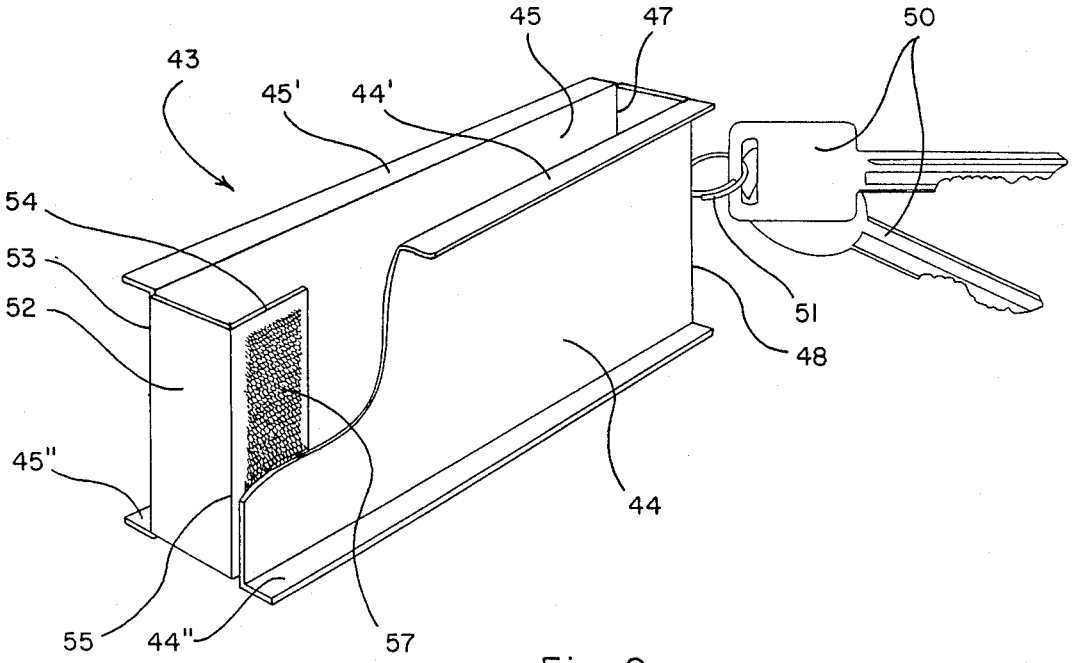
FIG. 9 is a perspective view of the removable item folded back on itself to form a key holder.

Once item 43 has been removed from chamber 12, flap 54 is disengaged from the exterior of channel-like half 44 and such halves are folded 180 degrees back on themselves. Flap 54 is also folded back 180 degrees thus again aligning the two portions of the Velcro securing means 57 as shown in FIG. 9. This folding back of storage item 43 exposes the attaching means 49 and its associated keys or other means 50 and acts very much as a key ring. The keys 50 can then be used to operate the vehicle or other means associated therewith.

Once the keys or other items 50 are desired to be replaced in chamber 12, the securing means 57 is released and the channel-like halves 44 and 45 manipulated 180 degrees from the open configuration of FIG. 9 to the closed configuration of FIGS. 7 and 8. The item 43 can then be reinserted into the chamber 12, as herein-above described, and the pass key 58 used to secure such item within said chamber. Such pass key 58 can then be removed and used on any one of the other chambers as desired.

Each of the pass keys 58 can either be color coded with a separate color assigned to each person who is allowed to use the same, or more conveniently, indicia in the form of a tag 60 with the authorized person's name or initials written thereon can be used. In any case, when an item has been removed from a chamber, the key is retained within the associated lock 24 and it will be known to all concerned the identity of the person who has removed such item.

From the above it can be seen that the present invention has the advantage of providing a control means for a plurality of items that are used by a plurality of people. Once one of these people has removed one of the items, they cannot remove a second item until the first item has been replaced due to the fact that the key is retained while such item is absent from its chamber. Once the item in question is returned to its chamber, the pass key can be removed and used to unlock any one of the other chambers selected.

The present invention is relatively inexpensive to produce and yet is highly efficient in controlling a plurality of items. The present invention also indicates at all times who has removed an item from the same, thus not only giving control of who has access to the items, but indicating who has removed an item from a given chamber.

The terms "front", "rear", "top", "bottom", "side", and so forth have been used herein merely for convenience to describe the control means of the present invention as oriented in the drawings. It is to be understood, that these terms are in no way limiting to the invention since the control means may obviously be disposed in different orientation when in use.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A system for managing the issuance of numerous selected articles comprising: a plurality of keys having identifying indicia; a cabinet containing a plurality of holding chambers; a plurality of article receptacles normally disposed within respective holding chambers, said article receptacles being movable between a retracted position in which access to the article within said receptacle is prevented and an extended position in which access to the article within said receptacle is permitted; means for biasing said article receptacles to their extended positions; a plurality of key retaining lock assemblies disposed in said cabinet adjacent respective holding chambers for locking said article receptacles in their retracted positions, each said key lock assembly including a key cylinder actuated by said keys and movable from a locked position in which said article receptacle is retained in a retracted position and an unlocked position in which said corresponding article receptacle is released from its retracted position and moved by said biasing means to its extended position, said key being retained in said cylinder when the same is in an unlocked position, said key retaining lock assembly further including means for preventing said key cylinder from being returned to its locked position until the corresponding article receptacle is returned to its holding chamber and placed in its retracted position.

2. The system for managing the issuance of plurality of articles of claim 1 wherein said key lock assemblies include a locking pin movable between an engaged position when said key cylinder is in a locked position wherein said locking pin engages said article receptacle and a disengaged position when said key cylinder is in an unlocked position.

3. The system for managing the issuance of a plurality of articles of claim 2 wherein said means for preventing said key cylinder from being returned to its locked position includes a slide plate which is biased by said biasing means to block the path of said locking pin when the same is in a disengaged position and said article receptacle is moved to its extended position and which is moved to a position out of the path of said locking pin when said article receptacle is moved to its retracted position.

* * * * *